United States Patent [19]

Shimbashi et al.

[11] 4,379,547

[45] Apr. 12, 1983

[54] CONTINUOUS COLD ROLLING AND ANNEALING APPARATUS FOR STEEL STRIP

[75] Inventors: Ichiro Shimbashi; Hiroshi Ikegami, both of Kitakyushu; Hideharu Bando, Tokyo, all of Japan

[73] Assignee: Nippon Steel Corporation, Tokyo, Japan

[21] Appl. No.: 252,805

[22] Filed: Apr. 10, 1981

[30] Foreign Application Priority Data

Apr. 11, 1980 [JP] Japan ..... 55-46935

[51] Int. Cl.[3] ..... C21D 7/02; C21D 9/56

[52] U.S. Cl. ..... 266/103; 266/87; 266/93; 266/110; 266/111; 72/201; 432/81; 432/43; 432/48; 432/59; 148/156

[58] Field of Search ..... 266/102, 103, 106, 108, 266/111, 110, 81, 87, 93; 148/156; 432/8, 59, 81, 85, 43, 48; 72/200, 201, 202; 226/118, 119

[56] References Cited

U.S. PATENT DOCUMENTS

| | | | |
|---|---|---|---|
| 2,266,330 | 12/1941 | Nachtman | 204/28 |
| 3,682,723 | 8/1972 | Riekkinen | 148/156 |
| 3,827,854 | 8/1974 | Gildersleeve | 432/19 |
| 4,174,097 | 11/1979 | Schwalm | 266/87 |

*Primary Examiner*—L. Dewayne Rutledge
*Assistant Examiner*—Christopher W. Brody
*Attorney, Agent, or Firm*—Cushman, Darby & Cushman

[57] ABSTRACT

A continuous cold rolling and annealing apparatus for a steel strip so that interruption of a cold rolling mill part does not directly cause a continuous annealing furnace part to be interrupted, in which apparatus at least one cold rolling mill is located upstream of the entrance of a continuous annealing furnace and an intermediate reel for supplying a spare steel strip coil to said continuous annealing furnace, is arranged between the cold rolling mill and the continuous annealing furnace.

5 Claims, 5 Drawing Figures

CONTINUOUS COLD ROLLING AND ANNEALING APPARATUS FOR STEEL STRIP

FIELD OF THE INVENTION

The present invention relates to a continuous cold rolling and annealing apparatus. More particularly, the present invention relates to an apparatus for continuously cold rolling and annealing a steel strip.

BACKGROUND OF THE INVENTION

Usually, in a steel strip producing apparatus, a cold rolling mill and a continuous annealing furnace are located in separate process lines from each other. That is, the cold rolling procedure for a steel strip is carried out independently from the continuous annealing procedure for the steel strip.

It is known that it is possible to sequentially carry out the cold rolling procedure and the continuous annealing procedure for the steel strip in one process line by placing a strip accmulator, for example, a strand looper or loop car, between the cold rolling mill and the continuous annealing furnace, so as to synchronize the cold rolling speed with the continuous annealing speed. It is known that the maximum speed of this type of continuous annealing furnace is about 500 m/min. When an economical accumulating capacity of the intermediate strip accumulator is about 1000 m at maximum, the cold rolling mills should be operated at a speed which is at the highest about 600 to about 700 m/min. That is, in order to connect the cold rolling process line with the continuous annealing process line through an intermediate strip accumulator so as to provide one process line, it is necessary that the cold rolling mills can be operated at the above-mentioned speed. The cold rolling process line may comprise 6 tandem high speed cold rolling mills or 4 tandem 6 high cold rolling mills and, optionally, a cold rolling drawing mill. Also, it is possible to synchronize a descaling procedure with the cold rolling procedure by placing a strip accumulator between a cold rolling mill and a descaling apparatus such as pickling apparatus, located upstream of the entrance of the cold rolling mill.

However, the continuous cold-rolling and annealing process line has not yet been realized, because stopping of the cold rolling part directly causes the continuous annealing part to be stopped and, therefore, the working efficiency of the continuous cold rolling and annealing process line significantly decreases.

The continuous annealing furnace is provided with a heating zone having a large heat capacity. Therefore, when the operation of the continuous annealing furnace is interrupted, it is very difficult to rapidly discharge the remaining heat from the heating zone, even if a heating means such as burner, is stopped. Accordingly, the steel strip located in the heating zone of the continuous annealing furnace is overheated by the remaining heat of the heating zone. This overheating sometimes causes the steel strip to be ruptured inside the continuous annealing furnace due to a heat buckling or drawing phenomenon. When the steel strip is ruptured inside in the furnace, it is necessary to open and cool the furnace, to remove the ruptured steel strip and, then, to charge a steel strip into the furnace. The above-mentioned procedures cause the continuous process line to be stopped over a long period of time and, therefore, the working efficiency of the process line is substantially decreased.

Generally, it is unavoidable that the cold rolling procedure is frequently interrupted due to the changing operation, adjusting operation and/or cleaning operation of the rolls. If the interruption of the cold rolling procedure always causes the interruption of the continuous annealing procedure, the working efficiency of the process line will decrease in a range of from about 10 to about 20%. In this case, it is practically impossible to continuously connect the cold rolling line with the continuous annealing line.

Under the above-mentioned circumstances, it is strongly desired by the steel-making industry to provide a continuous cold rolling and annealing process line which is free from the above-mentioned disadvantages of the conventional continuous lines.

SUMMARY OF THE INVENTION

An object of the present invention is to provide a continuous cold rolling and annealing apparatus for a steel strip, in which an interruption or speed reduction of the cold rolling part does not cause an interruption or speed reduction of the annealing part.

Another object of the present invention is to provide a continuous cold rolling and annealing apparatus for a steel strip, in which when the continuous annealing part is interrupted or speed reduced, the steel strip located therein can be protected from overheating.

The above-mentioned objects can be attained by the apparatus of the present invention, which comprises:

a cold rolling mill, a continuous annealing furnace having a heating zone, and;

an intermediate reel for supplying a spare steel strip to the continuous annealing furnace, the cold rolling mill being located upstream of the entrance of the continuous annealing furnace and the intermediate reel being located between the cold rolling mill and the continuous annealing furnace.

In the apparatus of the present invention, the heating zone of the continuous annealing furnace may be provided with an overheat-preventing device.

DETAILED DESCRIPTION OF THE INVENTION

Figure 1:
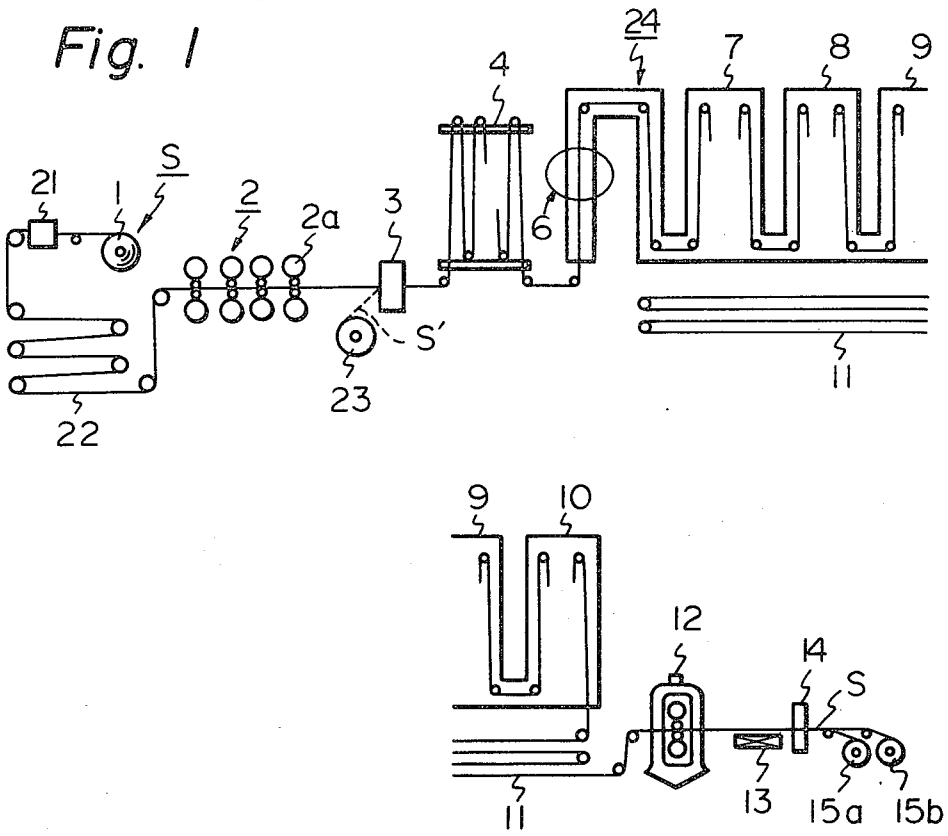
FIG. 1 is an explanatory diagram of an embodiment of a continuous cold rolling and annealing apparatus of the present invention.

The apparatus of the present invention is characterized in that an intermediate reel is located between a cold rolling mill and a continuous annealing furnace located downstream of the cold rolling mill.

In the apparatus in which the cold rolling mill part is followed by the continuous annealing furnace part in one process line, it is necessary that the interruption or speed reduction of the cold rolling mill part does not cause the continuous annealing furnace part to be interrupted or the speed to be reduced, or that the continuous annealing furnace part is capable of being interrupted or capable of rapidly reducing the speed in response to the interruption or speed reduction of the cold rolling mill part.

According to the results of research of the inventors of the present invention, it is possible to operate the continuous annealing furnace part independently from the interruption or speed reduction of the cold rolling mill part, by arranging a strip accumulator having a large strip-storage capacity between the cold rolling mill part and the continuous annealing furnace part. However, in this case, the resultant continuous process line is too large and useless from the economical view point.

Therefore, it is necessary to connect the cold rolling mill part to the continuous annealing furnace part through an intermediate strip accumulator having a relatively small size.

As a result of the study of the inventors, it was found that by placing an intermediate reel for decoiling a steel strip coil between the cold rolling mill part and the continuous annealing furnace part, the strip storage capacity of the strip accumulation can be decreased to the extent that the decreased strip storage capacity corresponds to the necessary period of time for placing a spare steel strip coil into the reel and preparing the uncoiling operation for the spare coil.

That is, when the cold rolling mill part is stopped, a spare steel strip can be supplied from the intermediate reel to the continuous annealing furnace part. While the spare steel strip is being supplied, the continuous annealing furnace part's speed can be reduced at a proper speed reducing rate determined in response to the thermal inertia of the furnace, or can be stopped. Accordingly, the interruption of the cold rolling mill part does not directly cause the continuous annealing furnace part to be immediately stopped, even if the strip storage capacity of the strip accumulator is small. Therefore, the continuous cold rolling and annealing apparatus can work with a high working efficiency.

When the continuous annealing furnace is stopped, the steel strip located in a heating zone having a temperature of 700° C. or more, is overheated and, frequently ruptured, as stated above. Therefore, it is preferable that the overheating of the steel strip can be prevented without decreasing the temperature of the heating zone. For this purpose, it is preferable that an overheat-preventing device is arranged in the heating zone of the continuous annealing furnace part. This device allows the continuous annealing furnace part to be rapidly speed reduced or stopped without overheating the steel strip.

The overheat-preventing device may be a device having a coolant path which is capable of positively absorbing heat irradiated from the heating zone of the furnace, or a device for ejecting a coolant toward the steel strip.

DETAILED DESCRIPTION OF THE DRAWINGS

The apparatus of the present invention will be further explained by referring to the accompanying drawings.

FIG. 1 shows an explanatory diagram of an embodiment of the continuous cold rolling and annealing apparatus of the invention. Referring to FIG. 1, a steel strip S is uncoiled from a coil placed on a pay-off reel 1 and welded to a foregoing steel strip by a welder 21. The steel strip S is forwarded along a loop car 22 and, then, fed into a group of cold rolling mills 2. The cold rolled steel strip S is introduced into a continuous annealing furnace 24 through, if necessary, an optional welder 3, and a strand looper 4. In the apparatus as indicated in FIG. 1, the continuous annealing furnace 4 is compared of a direct heating chamber 6, a temperature-holding chamber 7, a first cooling chamber 8, an overaging chamber 9 and a second cooling chamber 10. The annealed steel strip S is introduced into a skid pass mill 12 through a loop car 11. The annealed steel strip S is temper rolled by the skid pass mill 12.

The temper rolled steel strip S is greased by a greasing device 13 and, then, trimmed by a trimming machine 14. The resultant steel strip S is coiled into a coil 15*a* or 15*b*.

In FIG. 1, an intermediate pay-off reel 23 is arranged between the last cold rolling mills 2*a* and the entrance of the looper 4. Also, the optional welder 3 is arranged between the intermediate pay-off reel 23 and the looper 4. When the cold rolling mills are interrupted, a spare steel strip S' is uncoiled from a spare coil on the intermediate reel 23 and connected to the foregoing steel strip S by the optional welder 3. Therefore, the continuous annealing furnace part 24 can be continuously operated even when the cold rolling mill part is interrupted.

Figure 2:
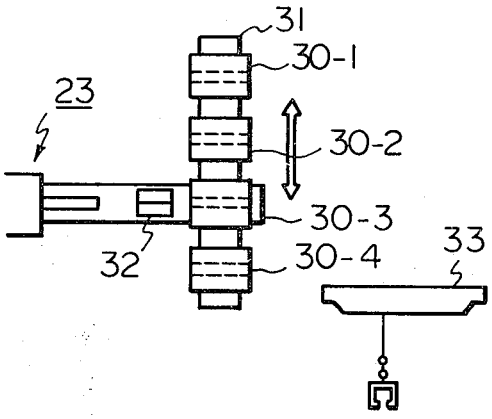
FIG. 2 is an explanatory diagram of an intermediate reel for supplying a spare steel coil to the apparatus of the present invention when the cold rolling mill is stopped.

Referring to FIG. 2, which shows an embodiment of the intermediate pay-off reel 23, the reel 23 is provided with a coil car 32 which is in contact with a coil skid 31. A plurality of spare coils 30-1, 30-2, 30-3 and 30-4 are supplied from a coil yard (not shown in the drawing) to the coil skid 31 by means of an automatic crane 33. The spare coils 30-1, 30-2, 30-3 and 30-4 may be different in type and/or size from each other. When the cold rolling mill part is interrupted, a desired type and size of spare coil is supplied to the intermediate reel 23 from the coil skid 31 by means of the coil car 32.

Figure 3:
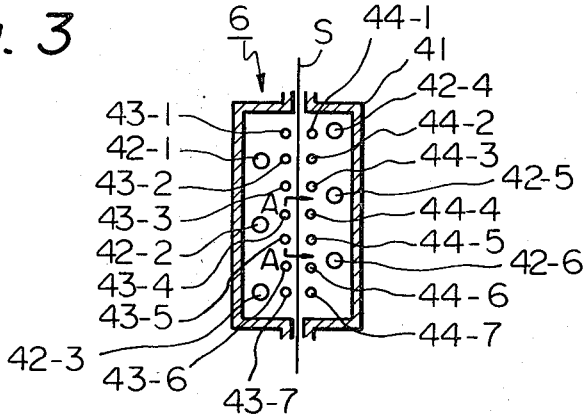
FIG. 3 shows an explanatory cross-sectional view of an embodiment of a continuous annealing furnace having an overheat-preventing device, usable for the present invention.
Figure 4:
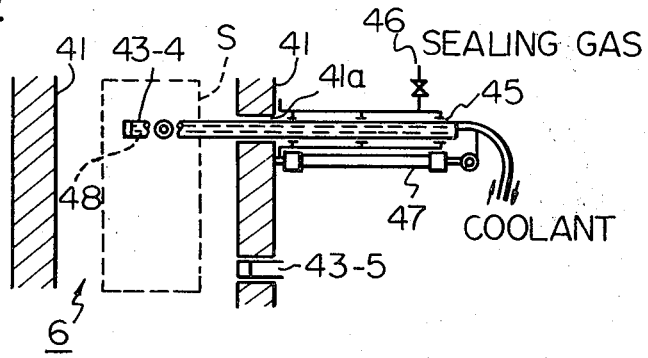
FIG. 4 shows a side view of a portion of the annealing furnace indicated in FIG. 3, along the line A—A in FIG. 3.

Referring to FIG. 1 and FIGS. 3 and 4 in which an embodiment of the direct heating chamber is shown, the cold rolled strip is introduced into a direct heating chamber 6 defined by a wall 41. The direct heating chamber 6 is provided with a plurality of gas burners 42-1 through 42-6, and a plurality of heat-shutting off bars 43-1 through 43-7 and 44-1 through 44-7. Each heat-shutting off bar is provided with a coolant path 48 formed therein and horizontally inserted into the inside of the direct heating chamber 6 parallel to the surface of the steel strip S, through a hole 41*a* formed in the wall 41. Each heat-shutting off bar is reciprocally movable through the hole 41*a* by means of an air cylinder 47. The hole 41*a* is sealed by means of a sealing chamber 45 into which a sealing gas such as nitrogen gas is formed through a sealing gas supply line 46. Accordingly, the inside of the direct heating chamber 6 is completely shut from the ambient atmosphere. The heat-shutting off bars absorb heat irradiated from the steel strip and the wall of the direct heating chamber so as to prevent the overheating of the steel strip, and cooled by the coolant flowing through the coolant path 48 formed therein.

Figure 5:
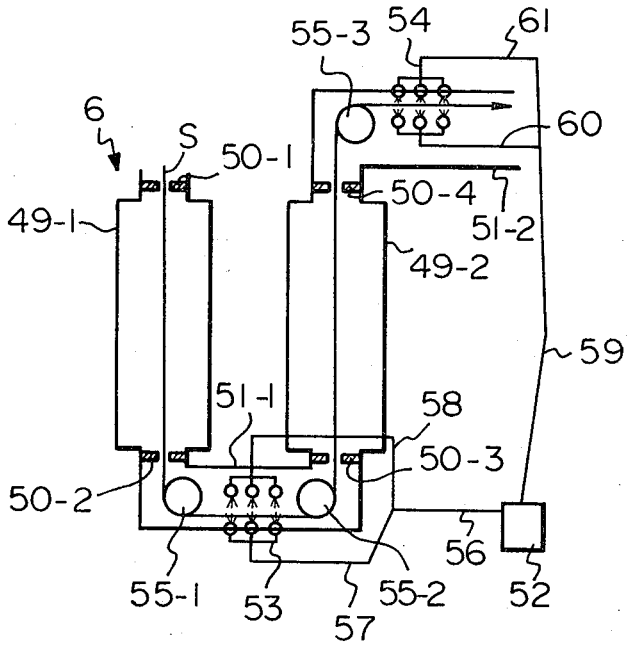
FIG. 5 is an explanatory diagram showing another embodiment of the annealing furnace having an overheat-preventing device, usable for the present invention.

When the operation of the annealing furnace part is interrupted the speed is reduced, the gas burners are stopped or partially shut off, and the heat-shutting off bars are inserted into the direct heating chamber in accordance with a predetermined program of a temperature control system for the direct heating chamber. Another heat-shutting off device is indicated in FIG. 5. In FIG. 5, the direct heating chamber 6 comprises vertical furnace portions 49-1 and 49-2, and horizontal furnace portions 51-1 and 51-2. The cold rolled strip S moves sequentially along guide rolls 55-1, 55-2, and 55-3 through the vertical furnace portion 49-1, the horizontal furnace portion 51-1, the vertical furnace portion 49-2 and the horizontal furnace portion 51-2. Each inside atmosphere in each furnace portion can be controlled by a pair of sealing means 50-1 and 50-2, 50-2 and 50-3 or 50-3 and 50-4.

Especially, the inside atmosphere of the horizontal furnace portion 51-1 is controlled by flowing nitrogen gas thereinto.

In the horizontal furnace portion 51-1, a plurality of coolant-ejecting nozzles 53 are located in the both sides of the moving path of the steel strip S. The nozzles 53 are connected to a coolant tank 52 through a main pipe line 56 and branched pipe lines 57 and 58. Also, in the horizontal furnace portion 51-2, a plurality of coolant-ejecting nozzles 54 are located in the same manner as that mentioned above. The nozzles 54 are connected to the coolant tank 52 through a main pipe line 59 and branched pipe lines 60 and 61.

When the operation of the continuous annealing furnace in interrupted or the speed is reduced, the coolant such as cooling water, is ejected under pressure toward both surfaces of the strip S which usually has a temperature of from 600° to 700° C. through the nozzles 53 and 54, in accordance with the predetermined program of the temperature control system for the direct heating chamber.

In accordance with the present invention, the cold rolling process line can be connected, for the first time, with the continuous annealing process line so as to form a single process line. This single cold rolling and annealing process line is highly valuable for the steel processing industry.

We claim:

1. A continuous cold rolling and annealing apparatus for a steel strip, comprising:
   - a continuous annealing furnace having a heating zone;
   - at least one cold rolling mill located upstream of the entrance of said continuous annealing furnace for cold rolling a steel strip;
   - an intermediate reel for supplying a spare steel strip to said continuous annealing furnace when the supply of the steel strip from the cold rolling mill is interrupted, said intermediate reel being located between said cold rolling mill and said continuous annealing furnace;
   - a welder for connecting said spare steel strip to a previously processed steel strip, said welder being located between said intermediate reel and said continuous annealing furnace;
   - a coil car for supplying a spare steel strip coil to said intermediate reel; and
   - a coil skid which is capable of holding a plurality of spare steel strip coils thereon and of moving each spare steel strip to a predetermined position for supplying it to said coil car.

2. The apparatus as claimed in claim 1, wherein said heating zone of said continuous annealing furnace is provided with a device for preventing overheating.

3. The apparatus as claimed in claim 2, wherein said device comprises a plurality of heat shut-off bars each having a path for flowing a coolant therethrough and each being removably inserted into and withdrawn from said heating zone in accordance with temperature conditions within said heating zone.

4. The apparatus as claimed in claim 2, wherein said device comprises a plurality of coolant-ejecting nozzles inserted into said heating zone.

5. The apparatus as claimed in claim 1, wherein a strand looper is located between said welder and intermediate reel and said continuous annealing furnace.

* * * * *